US010415158B2

(12) United States Patent
Stancl et al.

(10) Patent No.: US 10,415,158 B2
(45) Date of Patent: Sep. 17, 2019

(54) METHOD AND A DEVICE FOR REMOVING THE FAULTY YARN PORTION FROM A WORK STATION OF AN OPEN-ENDING SPINNING MACHINE

(71) Applicant: Rieter CZ s.r.o., Usti nad Orlici (CZ)

(72) Inventors: Jiri Stancl, Usti nad Orlici (CZ); Vladimir Skrivanek, Usti nad Orlici (CZ); Ladislav Hajek, Brandys nad Orlici (CZ)

(73) Assignee: Rieter CZ s.r.o., Usti nad Orlici (CZ)

( * ) Notice: Subject to any disclaimer, the term of this patent is extended or adjusted under 35 U.S.C. 154(b) by 290 days.

(21) Appl. No.: 15/089,830

(22) Filed: Apr. 4, 2016

(65) Prior Publication Data

US 2016/0289868 A1 Oct. 6, 2016

(30) Foreign Application Priority Data

Apr. 3, 2015 (CZ) ..... PV 2015-232

(51) Int. Cl.
*D01H 4/48* (2006.01)
*D01H 15/00* (2006.01)

(52) U.S. Cl.
CPC ..... *D01H 4/48* (2013.01); *D01H 15/00* (2013.01)

(58) Field of Classification Search
CPC ..... D01H 4/48
See application file for complete search history.

(56) References Cited

U.S. PATENT DOCUMENTS 4,397,139 A * 8/1983 Wey ..... B65H 69/00 57/22
4,676,059 A 6/1987 Artzt et al.
4,893,462 A 1/1990 Braun et al.
5,182,900 A * 2/1993 Horak ..... B65H 69/00 57/22
5,414,985 A 5/1995 Ball et al.
5,535,580 A 7/1996 Sebastian et al.
5,768,873 A * 6/1998 Stiller ..... B65H 69/00 57/22

(Continued)

FOREIGN PATENT DOCUMENTS

CZ 281 364 B6 10/1991
CZ 286 293 B6 8/1995

(Continued)

OTHER PUBLICATIONS

CZ Search Report, dated Dec. 28, 2015.
EP Search Report, dated Aug. 4, 2016.

*Primary Examiner* — Shaun R Hurley
(74) *Attorney, Agent, or Firm* — Dority & Manning, P.A.

(57) ABSTRACT

A method and device are provided for removing a faulty yarn portion at a work station of an open-end spinning machine after the work station is stopped in a controlled manner, particularly after a defect of the spun yarn is detected by a quality sensor. Prior to a request to connect a suction nozzle of the work station for sucking off of the faulty yarn portion, the value of a vacuum in a central channel of the vacuum system of the open-end spinning machine is determined and evaluated. The suction nozzle is connected to the central vacuum channel only after the current capacity of the vacuum source detected is sufficient, or only after a sufficiently high vacuum is achieved.

5 Claims, 1 Drawing Sheet

(56) References Cited

U.S. PATENT DOCUMENTS

| | | | | |
|---|---|---|---|---|
| 5,862,660 | A * | 1/1999 | Haasen | B65H 63/06 242/475.1 |
| 2002/0073683 | A1 * | 6/2002 | Zipperer | D01H 13/32 57/261 |
| 2013/0067879 | A1 | 3/2013 | Stephan et al. | |
| 2014/0360151 | A1 | 12/2014 | Meyer et al. | |

FOREIGN PATENT DOCUMENTS

| | | | |
|---|---|---|---|
| CZ | 280 898 | B6 | 2/1996 |
| DE | 10 2007 053 467 | A1 | 5/2009 |
| EP | 0 419 827 | | 4/1991 |
| EP | 2 530 193 | A1 | 12/2012 |
| EP | 2 573 228 | A2 | 3/2013 |
| EP | 2 801 646 | A1 | 11/2014 |

* cited by examiner

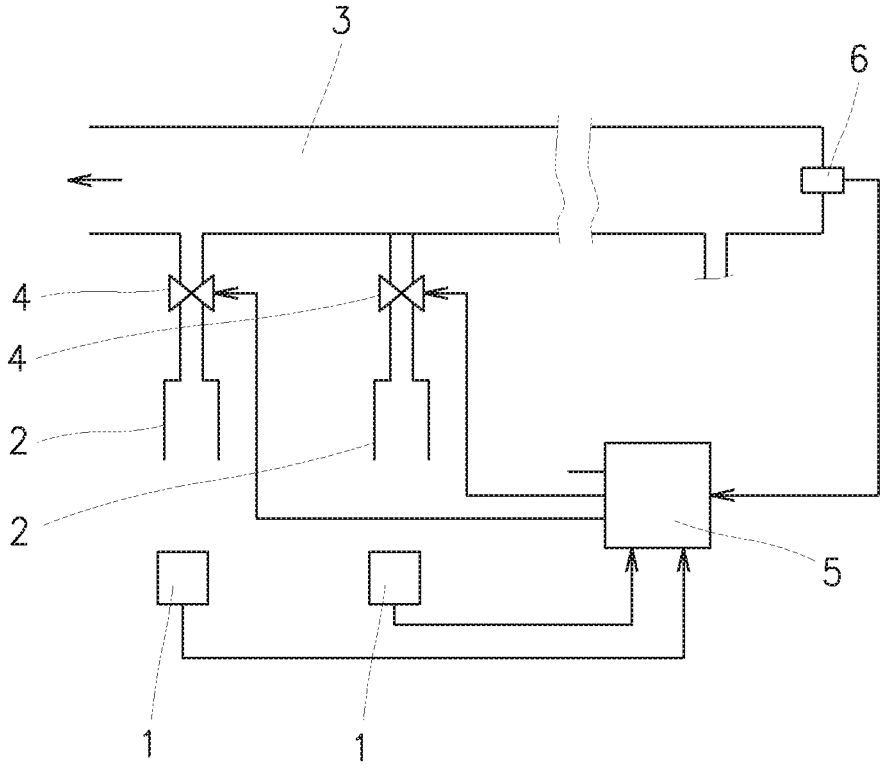
3
6
4
4
2
2
5
1
1

METHOD AND A DEVICE FOR REMOVING THE FAULTY YARN PORTION FROM A WORK STATION OF AN OPEN-ENDING SPINNING MACHINE

TECHNICAL FIELD

The present disclosure relates to a method for removing the faulty yarn portion from a work station of an open-end spinning machine after the work station is stopped in a controlled manner, especially after a defect of the spun yarn is detected by a sensor of the quality of yarn.

The disclosure also relates to a device for performing the method at a work station of an open-end spinning machine, whereby each work station of the machine comprises a suction nozzle for sucking the faulty yarn portion after the work station is stopped in a controlled manner.

BACKGROUND

The production of a spun yarn takes place on spinning machines comprising a plurality of work stations arranged in several substantially parallel rows. During the operation of the machine, it is impossible to rule out the possibility that a smaller or greater yarn portion containing defects is spun out. If these defects are visible, or if they negatively affect the mechanical properties of yarn, which are essential in the process of further application of yarn, it is necessary to ensure that the defective yarn portion will not get onto the final wound bobbin of the spun yarn. It is therefore necessary to cut out the faulty yarn portion and join the remaining ends of the high-quality yarn. Such joints represent a local change in yarn diameter, which entails making a compromise so that the new joint will not represent an even greater fault in the yarn than the fault detected by the sensor.

The operation of a modern open-end spinning machine or the steps carried out by the operator to meet the requirements for yarn quality are known. A spinning machine is at each work station provided with a sensor of yarn quality, the so-called yarn clearer, which monitors the running spun yarn, including its diameter and its changes, changes of the colour or structure of the yarn, etc. Current sensors of yarn quality are due to high sensitivity able to respond even to minor changes which, however, may occur even on yarn portions of a greater length which have to be removed.

If a yarn change is detected at a work station of the machine, which is a signal of a possible defect, the process of recording the yarn length is automatically started. If after a certain predetermined period of time the criterion for cleaning the yarn is not exceeded, recording the yarn length is terminated without further intervention. On the other hand, if within this period of time the criterion for cleaning the yarn is exceeded, spinning is automatically terminated at this work station and the total length of the yarn spun between the time of detecting a possible defect and the time when the spinning operation is terminated is determined.

A suction nozzle of a work station is connected to a vacuum system of an open-end spinning machine, whereupon the entire length of the faulty yarn is unwound from the final bobbin, sucked into the vacuum system of the open-end spinning machine, and deposited in a respective space allotted for waste, whereupon the operator finishes the preparation of yarn for a new spinning-in operation.

The vacuum system of the open-end spinning machine is used to suck in the yarn ends after cutting out the faulty yarn portion or after a yarn breakage, to unwind this portion of the already spun yarn from the final bobbin and to suck it off, or to join the ends of the high-quality yarn by a pneumatic splicer.

Taking into account a great plurality of work stations of an open-end spinning machine, the high requirements for uniformity of the spun yarn, and the frequent use of the vacuum system for suction of a relatively great length of the faulty yarn, there is a high probability of the necessity of sucking off the faulty yarn simultaneously from numerous work stations. Solving this problem by increasing the rated power input of the vacuum source is, for such high numbers of work stations of an open-end spinning machine, uneconomical.

This drawback is not solved by the background art, or it is addressed by uneconomical means. The aim of the invention is therefore to overcome this drawback without increasing the performance of the vacuum source.

SUMMARY OF THE INVENTION

Objects and advantages of the invention will be set forth in part in the following description, or may be obvious from the description, or may be learned through practice of the invention.

A goal of the invention is achieved by a method for removing the faulty yarn portion at a work station of an open-end spinning machine after a work station is stopped in a controlled manner, whose principle consists in that before the request to connect a suction nozzle of a work station for sucking off the faulty yarn portion, the value of the vacuum in the central channel of the vacuum system of an open-end spinning machine is determined and evaluated, and the suction nozzle of the work station is connected to the central vacuum channel only if the current capacity of the vacuum source detected is sufficient, or only after achieving sufficient vacuum.

The advantage is the fact that there cannot be such a decrease in vacuum which would lead to inefficient suction of yarn.

An aim of the invention is also achieved by a device whose principle consists in that each suction nozzle for sucking the faulty yarn portion is connected to the central channel of the vacuum system of an open-end spinning machine by means of a valve which, for the purpose of control, is coupled to a control unit connected to a vacuum meter arranged in the central channel of the vacuum system of an open-end spinning machine.

DESCRIPTION OF DRAWINGS

An exemplary embodiment of a device according to the invention is shown in FIG. 1, which schematically represents an arrangement of the connection of a work station of an open-end spinning machine to the central channel of the vacuum system of an open-end spinning machine.

DETAILED DESCRIPTION

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

A known work station of an open-end spinning machine comprises a spinning unit, from which the spun yarn is withdrawn by a drawing-off mechanism. A sensor 1 of the quality of yarn is situated in front of the drawing-off mechanism and a sensor of the presence of yarn is situated behind the drawing-off mechanism. The yarn is wound by a winding device onto a final bobbin. The work station comprises a suction nozzle 2 connected to the central channel 3 of the vacuum system of an open-end spinning machine by means of a stop valve 4.

The stop valves 4 are connected to the control unit 5, to which is also permanently connected the outlet of a vacuum meter 6 arranged in the central channel 3 of the vacuum system of the open-end spinning machine. The control unit 5 may be a control unit of a work station, or a control unit of a respective portion of the open-end spinning machine, or, optionally, it may be the central control unit of the open-end spinning machine.

The performance of the vacuum system of the open-end spinning machine is limited by a number of all the work stations simultaneously connected to the central channel 3 of the vacuum system of the open-end spinning machine.

The instantaneous value of vacuum needed for sucking off the defective yarn at one work station of the machine is known and is stored in the memory of the control unit 5 of the machine.

The minimum value of vacuum needed for unwinding the faulty yarn portion from the final bobbin and sucking it off out of the work station, and thus the requirement for the capacity of the vacuum source, is defined. An insufficient level of the vacuum would result in an incorrect operation of the device.

After detecting a defect of the spun yarn by a quality sensor 1 and after passing the particular signal to the control unit 5 the control unit 5 stops the particular work station in a controlled manner. This activity includes unwinding the spun faulty yarn portion at the particular work station of the machine. The control unit 5 finds out the current value of the vacuum in the central channel 3 of the vacuum system of the machine sensed by the vacuum meter 6 and evaluates it as the remaining capacity of the unillustrated vacuum source.

If this remaining capacity is sufficient, the signal of the control unit 5 opens the stop valve 4 of the particular work station, whereupon suction of the faulty yarn portion by the suction nozzle 2 is started, as well as its removal to the unillustrated waste space.

If the remaining capacity is insufficient for reliable operation of another work station, the control unit 5 does not give a signal to open the stop valve 4 at another work station and waits until the process of unwinding and sucking off the faulty yarn portion at any of the currently simultaneously attended work stations is terminated. It is only after terminating the operation at any of the currently simultaneously attended work stations and after detecting new data and evaluating the current capacity of the vacuum source, the control unit 5 sends a signal to the waiting work station. Upon this signal, the stop valve 4 opens and the suction nozzle 2 is connected to the central channel 3 of the vacuum system of an open-end spinning machine, by which means the operation of sucking off and unwinding the faulty yarn portion is started.

The advantage of the method and device according to the invention is performing properly the operation of sucking off the defective portion of the spun yarn and removing it out of the work station of an open-end spinning machine without having to use a high-performance vacuum source. The loss caused by the downtime of the work station waiting for the necessary vacuum in the suction channel is usually lower than are the acquisition and operating costs which would be required by a more powerful source of vacuum.

Modifications and variations can be made to the embodiments illustrated or described herein without departing from the scope and spirit of the invention as set forth in the appended claims.

LIST OF REFERENCES

1 sensor of yarn quality
2 suction nozzle (of a work station or attending device)
3 central channel of a vacuum system of an open-end spinning machine
4 stop valve of vacuum at a work station control unit of an open-end spinning machine
6 vacuum meter in the central channel of the vacuum system of an open-end spinning machine

The invention claimed is:

1. A method for removing a faulty yarn portion from a running yarn at a first work station of an open-end spinning machine, comprising:
- after detecting a defect in the spun yarn with a yarn quality sensor, stopping the first work station in a controlled manner;
- prior to connecting a first suction nozzle at the first work station to a central vacuum channel of a vacuum system of the open-end spinning machine for sucking off a portion of the yarn containing the defect, performing the following:
  - determining a value of the vacuum in the central vacuum channel of the vacuum system;
  - connecting the first suction nozzle to the central vacuum channel when vacuum in the central vacuum channel is at or achieves a sufficient predefined capacity; and
  - continuing to monitor the vacuum in the central vacuum channel and, if capacity would be insufficient, preventing connection of a second suction nozzle at a second work station to the central vacuum channel until the connection of the first suction nozzle is terminated.

2. A work station of an open-end spinning machine, comprising:
- a suction nozzle for sucking off a yarn portion containing a defect after the work station is stopped in a controlled manner;
- a central vacuum channel, the suction nozzle in communication with the central vacuum channel;
- a controllable valve disposed between the suction nozzle and the central vacuum channel;
- a control unit, the valve in communication with the control unit;
- a vacuum meter configured to determine a vacuum in the central vacuum channel; and
- wherein the control unit is in communication with the vacuum meter and is configured to:
  - open the valve to connect the suction nozzle to the central vacuum channel only after determining that predefined vacuum capacity exists in the central vacuum channel; and
  - continue to monitor the vacuum in the central vacuum channel and, if capacity would be insufficient, preventing connection of a second suction nozzle at a second work station to the central vacuum channel until the connection of the suction nozzle is terminated.

3. The work station according to claim 2, wherein the control unit is configured as a work station control unit that controls spinning operation at the work station.

4. The work station according to claim 2, wherein the control unit is configured as a control unit of a portion of the open-end spinning machine.

5. The work station according to claim 2, wherein the control unit is configured as a control unit of the open-end spinning machine.

* * * * *